US010173241B2

(12) United States Patent
Li et al.

(10) Patent No.: US 10,173,241 B2
(45) Date of Patent: Jan. 8, 2019

(54) COATING METHOD

(71) Applicants: BOE Technology Group Co., Ltd., Beijing (CN); Hefei BOE Optoelectronics Technology Co., Ltd., Anhui (CN)

(72) Inventors: Zhiqiang Li, Beijing (CN); Dongdong Yin, Beijing (CN); Xuepei Cheng, Beijing (CN); Zhi Liu, Beijing (CN); Wei Zhang, Beijing (CN)

(73) Assignees: BOE Technology Group Co., Ltd., Beijing (CN); Hefei BOE Optoelectronics Technology Co., Ltd., Hefei (CN)

( * ) Notice: Subject to any disclaimer, the term of this patent is extended or adjusted under 35 U.S.C. 154(b) by 0 days.

(21) Appl. No.: 15/131,209

(22) Filed: Apr. 18, 2016

(65) Prior Publication Data

US 2016/0310985 A1 Oct. 27, 2016

(30) Foreign Application Priority Data

Apr. 22, 2015 (CN) ..... 2015 1 0194299

(51) Int. Cl.
*B05D 1/02* (2006.01)
*B05D 1/00* (2006.01)
*B05B 1/00* (2006.01)

(52) U.S. Cl.
CPC ..... *B05D 1/02* (2013.01); *B05B 1/00* (2013.01); *B05D 1/00* (2013.01)

(58) Field of Classification Search
None
See application file for complete search history.

(56) References Cited

U.S. PATENT DOCUMENTS

2003/0221615 A1* 12/2003 Lastowka ..... B05B 15/08 118/679
2004/0090589 A1* 5/2004 Jung ..... G02F 1/1339 349/187
2004/0117131 A1* 6/2004 Peters ..... G06F 11/321 702/34
2008/0230177 A1* 9/2008 Crouser ..... G02F 1/133502 156/275.5
2011/0297590 A1* 12/2011 Ackley ..... B07C 5/3422 209/580

FOREIGN PATENT DOCUMENTS

JP 07031917 A * 2/1995

* cited by examiner

*Primary Examiner* — Michael P. Rodriguez
(74) *Attorney, Agent, or Firm* — Banner & Witcoff, Ltd.

(57) ABSTRACT

Embodiments of the present invention disclose a coating method, comprising determining a coating state of a current substrate being an uncoated state in which none of a predetermined coating is coated thereon, a coating underway state in which a part of the predetermined coating is coated thereon or a coating completion state in which all of the predetermined coating is coated thereon, when a coating suspension is detected during coating the current substrate; in a case that the current substrate is in the uncoated state, further coating the current substrate or starting coating a next substrate; and in a case that the current substrate is in the coating underway state or the coating completion state, starting coating a next substrate.

9 Claims, 3 Drawing Sheets

COATING METHOD

This application claims priority to and the benefit of Chinese Patent Application No. 201510194299.3 filed on Apr. 22, 2015, which application is incorporated herein in its entirety.

TECHNICAL FIELD

Embodiments of the present disclosure relate to a coating method.

BACKGROUND

A coating machine is one of the key devices in a manufacturing process of a display panel, and is used for uniformly coating substances such as photoresist or sealant in a region to be coated of a substrate of the display panel.

SUMMARY

An embodiment of the present invention discloses a coating method, comprising determining a coating state of a current substrate being an uncoated state in which none of a predetermined coating is coated thereon, a coating underway state in which a part of the predetermined coating is coated thereon or a coating completion state in which all of the predetermined coating is coated thereon, when a coating suspension is detected during coating the current substrate; in a case that the current substrate is in the uncoated state, further coating the current substrate or starting coating a next substrate; and in a case that the current substrate is in the coating underway state or the coating completion state, starting coating a next substrate.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to clarify the aims, technical solutions and advantages of the embodiments of the present invention, the technical solutions of the embodiments will be described in a clearly and fully understandable way in combination with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

In a related art, in a coating process by using a coating machine, the coating machine can monitor information such as a thickness of a substrate, a lifting position of a nozzle, a coating speed, a size of a coating gap and perception of foreign matter on a surface of the substrate in real time, and when any of the above information exceeds a preset range, the coating machine stops coating to ensure uniformity of coating. When the coating machine stops coating, an operator has two processes as follows: one comprises: marking the current substrate, transferring the substrate to a downstream device but not performing a subsequent process, and coating a next substrate; and after the manufacturing process of a display panel is finished, selecting the marked substrate for preparing other products; the other one comprises: deleting recorded information of the current substrate in the coating machine after the current substrate is taken out of the coating machine, and coating the next substrate.

In an actual coating process, the coating machine stops working when the information monitored in real time has abnormity, which may be caused by many reasons such as faults of the coating machine or defects of the substrate, while the operator only performs a process step of marking the substrate or taking the substrate out of the coating machine, which cannot detect and remove faults effectively, or even cause a waste of resources.

Figure 1:
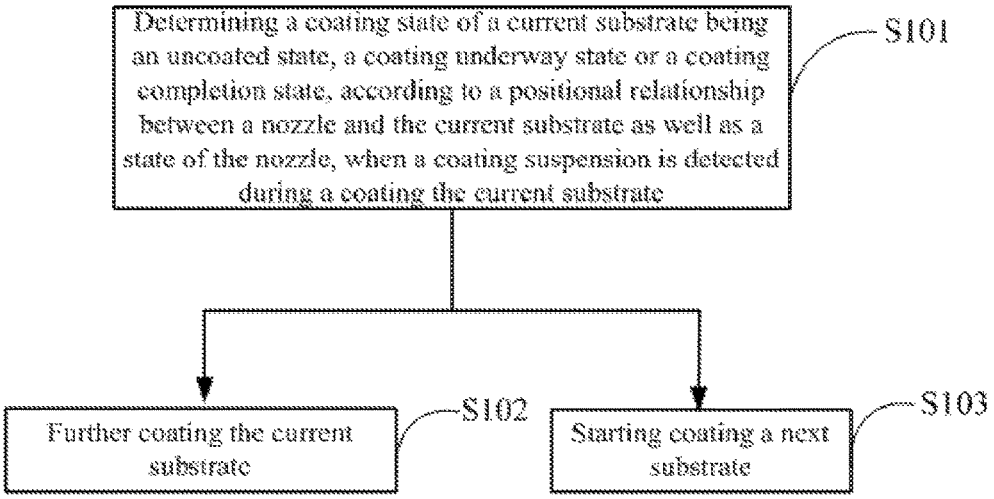
FIG. 1 is a flow chart of a coating method according to one embodiment of the present invention.

A coating method provided in an embodiment of the present invention, as shown in FIG. 1, comprises steps of:

Determining a coating state of a current substrate being an uncoated state in which none of a predetermined coating is coated thereon, a coating underway state in which a part of the predetermined coating is coated thereon, or a coating completion state in which all of the predetermined coating is coated thereon the substrate, according to a positional relationship between a nozzle and the current substrate as well as a state of the nozzle, when a coating suspension is detected during coating the current substrate; in a case of the coating state of the current substrate is determined to be the uncoated state, executing step S102 or step S103; in a case of the coating state of the current substrate is determined to be the coating underway or the coating completion state, executing step S103, wherein the step S102 is further coating the current substrate and the step S103 is starting coating a next substrate.

In the coating method provided in the embodiment of the present invention, the coating state of the current substrate is determined to be the uncoated state, the coating underway state or the coating completion state, according to the positional relationship between the nozzle and the current substrate as well as the state of the nozzle, when the coating suspension is detected during coating the current substrate; for the uncoated state, the current substrate is further coated or the coating of the next substrate is started; for the coating underway state and the coating completion state, the coating of the next substrate is started. Thus, different processes are adopted according to different coating states. Compared with the processes in the related coating method, wherein the coating of the next substrate is directly started after the current substrate is marked or the coating of the next substrate is started after the current substrate is taken out of the coating machine hen the coating suspension is detected, the coating method provided by the embodiment of the present invention not only can detect and remove faults effectively, but also can avoid a waste of resources.

For example, in the coating method provided in the embodiment of the present invention, during sequentially coating respective substrates by the coating machine, the coating machine monitors information such as a thickness of the substrate, a lifting position of a nozzle, a coating speed, a size of a coating gap and perception of foreign matter on a surface of the substrate in real time, and when any of the above information exceeds a preset range, uniformity of coating is affected. Therefore, in order to ensure the uniformity of coating, the coating machine stops coating when any of the above information exceeds the preset range.

For example, according to the method provided in the embodiment of the present invention, the step S101 of determining the coating state of the current substrate according to the positional relationship between the nozzle and the current substrate as well as the state of the nozzle, for example, can be implemented in such manners of: determining the coating state of the current substrate being the uncoated state, when the nozzle is positioned in an initial coating position of the current substrate (namely the position where the coating of the current substrate starts) and the state of the nozzle is a feed-stop state; determining the coating state of the current substrate being the coating underway state, when the nozzle is in a position in a region of the current substrate to be coated and the state of the nozzle is a feeding state; determining the coating state of the current substrate being the coating completion state, when the nozzle is in a position, except the initial coating position, in the region of the current substrate to be coated and the state of the nozzle is the feed-stop state. Herein, the feed-stop state of the nozzle refers to a state where the nozzle stops feeding a material to be coated onto the substrate, while the feeding state of the nozzle refers to a state where the nozzle feeds the material to be coated onto the substrate. For example, when the initial coating position of the current substrate is at 972 mm, and a coating distance is 1850 mm, then the coating range of the current substrate is at 972-2822 mm, when the nozzle is in a position of 972 mm and the state of the nozzle is the feed-stop state, it is determined that the coating state of the current substrate is the uncoated state; when the nozzle is in a position within 972-2822 mm and the state of the nozzle is the feeding state, it is determined that the coating state of the current substrate is the coating underway state; when the nozzle is in the position within 972-2822 mm (not including the position of 972 mm) and the state of the nozzle is the feed-stop state, it is determined that the coating state of the current substrate is the coating completion state. It should be noted that when the nozzle is in the position within 972-2822 mm (not including the position of 972 mm and the position of 2822 mm) and the state of the nozzle is the feed-stop state, the nozzle is in a returning state.

Certainly, the method of determining the coating state of the current substrate is not limited thereto, and the coating state of the current substrate can be determined according to the positional relationship between the nozzle and the current substrate as well as whether the pump feeds the material, which is not limited herein.

Figure 2:
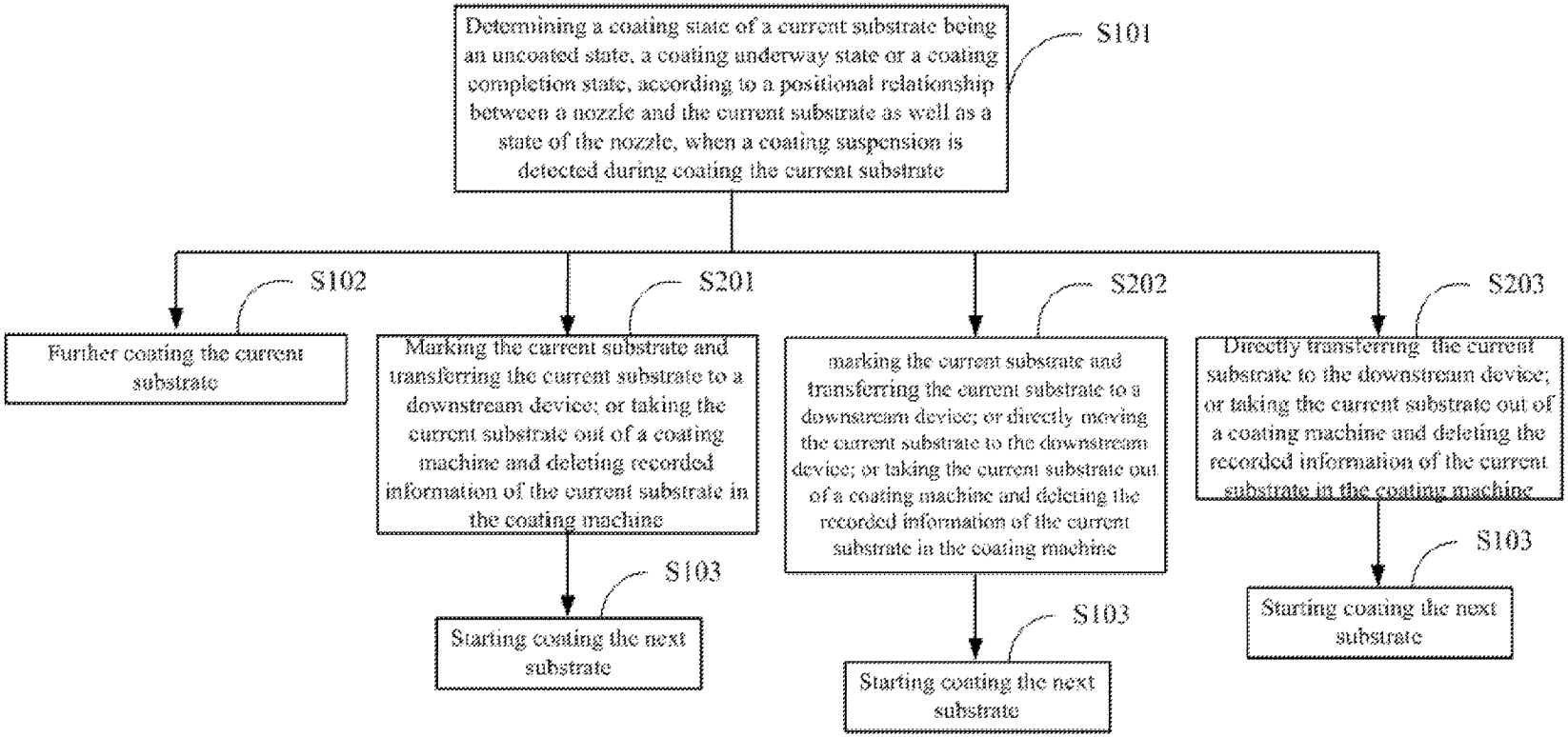
FIG. 2 is a flow chart of a coating method according to another embodiment of the present invention.

For example, in the method provided in the embodiment of the present invention, when it is determined that the coating state of the current substrate is the uncoated state and before the step S103 of starting coating the next substrate is executed, as shown in FIG. 2, the method further comprises a step of:

S201: marking the current substrate and transferring the current substrate to the downstream device; or taking the current substrate out of the coating machine and deleting the recorded information of the current substrate in the coating machine.

Figure 3:
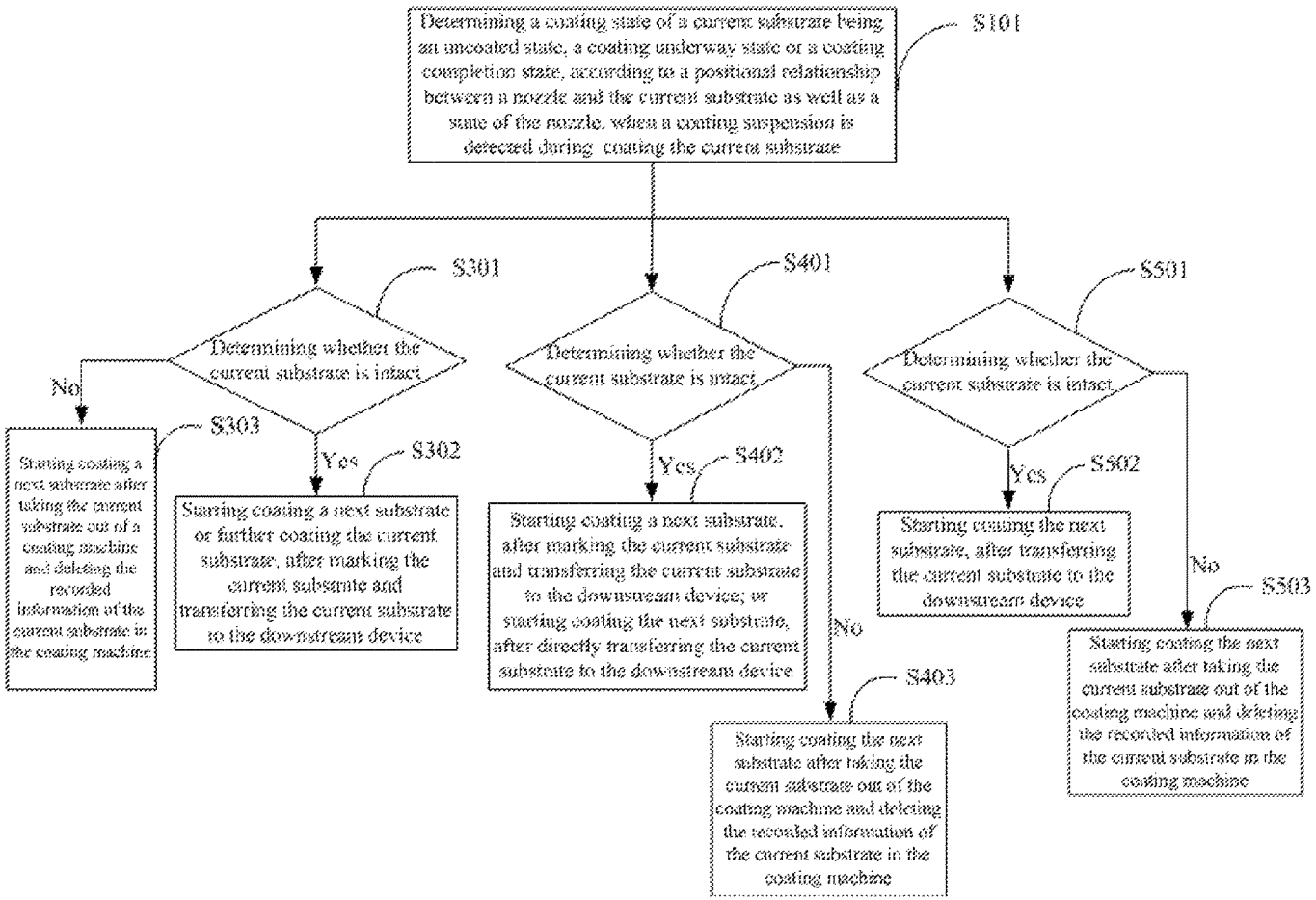
FIG. 3 is a flow chart of a coating method according to a further embodiment of the present invention.

For example, in the method provided in the embodiment of the present invention, when it is determined that the coating state of the current substrate is the uncoated state, the step S102 of further coating the current substrate in the method provided in the embodiment of the present invention is executed; or after the step S201 of marking the current substrate and transferring the current substrate to the downstream device, or taking the current substrate out of the coating machine and deleting the recorded information of the current substrate in the coating machine is executed, executing the step S103 of starting coating the next substrate in the method provided in the embodiment of the present invention, as shown in FIG. 3, which can be implemented in such manners of:

S301: determining whether the current substrate is intact; if yes, executing step S302; if no, executing step S303;

S302: starting coating the next substrate or further coating the current substrate, after marking the current substrate and transferring the current substrate to the downstream device;

S303: starting coating the next substrate, after taking the current substrate out of the coating machine and deleting the recorded information of the current substrate in the coating machine.

It should be noted that many reasons may result in stop of the coating, for example, abnormity of the coating machine (accidental abnormities such as insufficient lubricating oil), problems of the substrate per se, etc. As for the accidental abnormities, recoating can be a solution. Therefore, in the method provided in the embodiment of the present invention, when it is determined that the coating state of the current substrate is the uncoated state and the current substrate is intact, when the step S302 of starting the coating of the next substrate or further coating the current substrate, after marking the current substrate and transferring the current substrate to the downstream device, is executed, for example, the current substrate is firstly recoated; if the recoat processing cannot solve the problem, the current substrate may be marked and moved to the downstream device, and then the coating of the next substrate is started, which thus facilitates detecting and retransferring faults, and improves efficiency in detecting and retransferring faults.

For example, in the method provided in the embodiment of the present invention, when the coating machine determines that the coating state of the current substrate is the uncoated state and the current substrate is further coated, if a coating suspension is detected again, according to the positional relationship between the nozzle and the current substrate as well as the state of the nozzle, it is re-determined that the coating state of the current substrate is the uncoated state, the coating underway state or the coating completion state; and the corresponding process is performed again according to the coating states re-determined by the coating machine.

For example, in the method provided in the embodiment of the present invention, when it is determined that the coating state of the current substrate is the coating underway state, before the step S103 of starting the coating of the next substrate is executed, as shown in FIG. 2, the method further comprises a step of:

S202: marking the current substrate and transferring the current substrate to the downstream device; or directly transferring the current substrate to the downstream device; or taking the current substrate out of the coating machine and deleting the recorded information of the current substrate in the coating machine.

For example, in the method provided in the embodiment of the present invention, when it is determined that the coating state of the current substrate is the coating underway state, after performing the step S202 of marking the current substrate and transferring the current substrate to the downstream device; or directly transferring the current substrate to the downstream device; or taking the current substrate out of the coating machine and deleting the recorded information of the current substrate in the coating machine, performing the step S103 of starting the coating of the next substrate in the method provided in the embodiment of the present invention, as shown in FIG. 3, which can be implemented in such manners of:

S401: determining whether the current substrate is intact; if yes, executing step S402; if no, executing step S403;

S402: starting coating the next substrate, after marking the current substrate and transferring the current substrate to the downstream device; or starting coating the next substrate, after directly transferring the current substrate to the downstream device;

S403: starting coating the next substrate, after taking the current substrate out of the coating machine and deleting the recorded information of the current substrate in the coating machine.

For example, in the method provided in the embodiment of the present invention, when it is determined that the coating state of the current substrate is the coating underway state and the current substrate is intact, the step S402 of starting coating the next substrate, after marking the current substrate and transferring the current substrate to the downstream device, or starting coating the next substrate, after directly transferring the current substrate to the downstream device, can be implemented in such manners of: determining whether to start coating the next substrate after marking the current substrate and transferring the current substrate to the downstream device, or start coating the next substrate after directly transferring the current substrate to the downstream device, according to a ratio of a size of a coated region to a size of an uncoated region in the region of the current substrate to be coated. For example, the ratio of the size of the coated region to the size of the uncoated region is not specifically defined, and it can be determined according to an actual condition. For example, when the ratio of the size of the coated region to the size of the uncoated region of the current substrate is larger, namely, when the coating process for the current substrate is about to be completed, the possibility of directly transferring the current substrate to the downstream device without marking the current substrate is greater, and the substrate can be marked in a subsequent process. After the manufacturing process of the display panel is finished, the uncoated part in the substrate can be removed while the coated part in the substrate is remained, thus avoiding the waste of resources.

For example, in the method provided in the embodiment of the present invention, when it is determined that the coating state of the current substrate is the coating completion state, before the step S103 of starting coating the next substrate is executed, as shown in FIG. 2, the method further comprises a step of:

S203: directly transferring the current substrate to the downstream device; or taking the current substrate out of the coating machine and deleting the recorded information of the current substrate in the coating machine.

For example, in the method provided in the embodiment of the present invention, when it is determined that the coating state of the current substrate is the coating completion state, after performing the step S203 of directly transferring the current substrate to the downstream device; or taking the current substrate out of the coating machine and deleting the recorded information of the current substrate in the coating machine, performing the step S103 of starting the coating of the next substrate in the method provided in the embodiment of the present invention, as shown in FIG. 3, for example, which can be implemented in such manners of:

S501: determining whether the current substrate is intact; if yes, executing step S502; if no, executing step S503;

S502: starting coating the next substrate, after transferring the current substrate to the downstream device;

S503: starting coating the next substrate, after taking the current substrate out of the coating machine and deleting the recorded information of the current substrate in the coating machine.

It should be noted that in the case where the current substrate is marked and transferred to the downstream device, for example, no further manufacturing process is performed thereto when the current substrate passes by the downstream device. After the manufacturing process of the display panel is finished, the marked substrate can be selected for preparing other products; in the case where the current substrate is directly transferred to the downstream device without being marked, a normal manufacturing process is further performed when the current substrate passes by the downstream device; in the case where the current substrate is taken out of the coating machine and the recorded information of the current substrate in the coating machine is deleted, the current substrate taken out may be abandoned.

It should be noted that the coating method provided in the embodiments of the present invention can be specifically applied for coating of photoresist, or coating of sealant, etc., which is not limited herein.

According to the coating method provided in the embodiments of the present invention, the coating state of the current substrate is determined to be one of the uncoated state, the coating underway state and the coating completion state, according to the positional relationship between the nozzle and the current substrate and the state of the nozzle, when the coating suspension is detected during coating the current substrate; for the uncoated state, the current substrate is further coated or the coating of the next substrate is started; for the coating underway state and the coating completion state, the coating of the next substrate is started. Thus, different processes are adopted according to different coating states. Compared with the processes in the existing coating method, wherein the coating of the next substrate is directly started after the current substrate is marked or the coating of the next substrate is started after the current substrate is taken out of the coating machine when the coating suspension is detected, the method provided by embodiments of the present invention not only can detect and remove faults effectively, but also can avoid a waste of resources.

Although the embodiments of the invention have been described above in great detail with general descriptions and specific embodiments, on the basis of the embodiments of the invention, various changes and improvements may be made, which is apparent to those skilled in the art. Therefore, all such changes and improvements without departing from the spirit of the invention are within the scope of the claims of the invention.

The application claims priority of Chinese Patent Application No. 201510194299.3 filed on Apr. 22, 2015, the disclosure of which is incorporated herein by reference in its entirety as part of the present application.

The invention claimed is:

1. A coating method adapted for a coating machine, comprising:

determining a coating state of a current substrate being an uncoated state in which none of a predetermined coating is coated thereon, a coating underway state in which a part of the predetermined coating is coated thereon or a coating completion state in which all of the predetermined coating is coated thereon, when the coating machine stops working in response to an abnormity in monitored information during coating the current substrate, wherein the current substrate is a substrate of a display panel;

in a case that the current substrate is in the uncoated state, further coating the current substrate or starting coating a next substrate; and in a case that the current substrate is in the coating underway state or in the coating completion state, starting coating the next substrate, wherein the determining a coating state of the current substrate is executed only according to a relative position of a nozzle with respect to the current substrate, and whether the nozzle feeds a material.

2. The method according to claim 1, wherein the coating state of the current substrate is determined to be the uncoated state, when the nozzle is positioned in an initial coating position of the current substrate and a state of the nozzle is a feed-stop state;

the coating state of the current substrate is determined to be the coating underway state, when the nozzle is in a position in a region of the current substrate to be coated and the state of the nozzle is a feeding state; and the coating state of the current substrate is determined to be the coating completion state, when the nozzle is in a position, except the initial coating position, in the region of the current substrate to be coated and the state of the nozzle is the feed-stop state.

3. The method according to claim 1, wherein, in the case that the current substrate is in the uncoated state, before the starting coating the next substrate, the method further comprises:

marking the current substrate and transferring the current substrate to a downstream device; or taking the current substrate out of the coating machine and deleting, in the coating machine, recorded information of the current substrate.

4. The method according to claim 3, wherein, in the case that the current substrate is in the uncoated state, the further coating the current substrate; or the starting coating the next substrate after marking the current substrate and transferring the current substrate to a downstream device; or the starting coating the next substrate after taking the current substrate out of the coating machine and deleting the recorded information of the current substrate, includes:

determining whether the current substrate is intact; if yes, starting coating the next substrate after marking the current substrate and transferring the current substrate to the downstream device, or further coating the current substrate; if no, starting coating the next substrate after taking the current substrate out of the coating machine and deleting the recorded information of the current substrate.

5. The method according to claim 1, wherein, in a case that the current substrate is in the coating underway state, before the starting coating the next substrate, the method further comprises:

marking the current substrate and transferring the current substrate to a downstream device; or directly transferring the current substrate to the downstream device; or taking the current substrate out of the coating machine and deleting, in the coating machine, recorded information of the current substrate.

6. The method according to claim 5, wherein, in the case that the current substrate is in the coating underway state, the starting coating the next substrate after marking the current substrate and transferring the current substrate to a downstream device; or the starting coating the next substrate after directly transferring the current substrate to the downstream device; or the starting coating the next substrate after taking the current substrate out of the coating machine and deleting the recorded information of the current substrate includes:

determining whether the current substrate is intact; if yes, starting coating the next substrate after marking the current substrate and transferring the current substrate to the downstream device, or starting coating the next substrate after directly transferring the current substrate to the downstream device; if no, starting coating the next substrate after taking the current substrate out of the coating machine and deleting the recorded information of the current substrate.

7. The method according to claim 6, wherein, in the case that the current substrate is in the coating underway state, the starting coating the next substrate after marking the current substrate and transferring the current substrate to the downstream device; or the starting coating the next substrate after directly transferring the current substrate to the downstream device, includes:

determining whether to start coating the next substrate after marking the current substrate and transferring the current substrate to the downstream device or start coating the next substrate after directly transferring the current substrate to the downstream device, according to a ratio of a size of a coated region to a size of an uncoated region in a region of the current substrate to be coated.

8. The method according to claim 1, wherein, in the case that the current substrate is in the coating completion state, before the starting coating the next substrate, the method further comprises:

directly transferring the current substrate to a downstream device; or taking the current substrate out of the coating machine and deleting, in the coating machine, recorded information of the current substrate.

9. The method according to claim 8, wherein, in the case that the current substrate is in the coating completion state, the starting coating the next substrate after directly transferring the current substrate to the downstream device; or the starting coating the next substrate after taking the current substrate out of the coating machine and deleting the recorded information of the current substrate, includes:

determining whether the current substrate is intact, if yes, starting coating the next substrate after directly transferring the current substrate to the downstream device; if no, starting coating the next substrate after taking the current substrate out of the coating machine and deleting, in the coating machine, the recorded information of the current substrate.

* * * * *